United States Patent [19]

Seld

[11] Patent Number: 4,856,696

[45] Date of Patent: Aug. 15, 1989

[54] PNEUMATICALLY OPERATED DRIVING TOOL FOR FASTENERS

[75] Inventor: Sigurd V. Seld, Hamburg, Fed. Rep. of Germany

[73] Assignee: Joh. Friedrich Behrens AG, Ahrensburg, Fed. Rep. of Germany

[21] Appl. No.: 210,235

[22] Filed: Jun. 23, 1988

[30] Foreign Application Priority Data

Jul. 1, 1987 [EP] European Pat. Off. ..... 87109438.9

[51] Int. Cl.[4] ..... B25C 1/04

[52] U.S. Cl. ..... 227/130; 227/8; 227/149

[58] Field of Search ..... 227/8, 130, 113, 149

[56] References Cited

U.S. PATENT DOCUMENTS

| | | | |
|---|---|---|---|
| 3,434,643 | 3/1969 | Wandel | 227/130 |
| 4,003,417 | 1/1977 | Cornwell | 227/149 X |
| 4,389,012 | 6/1983 | Grikis et al. | 227/120 |

*Primary Examiner*—Frank T. Yost
*Assistant Examiner*—James L. Wolfe
*Attorney, Agent, or Firm*—Brown, Martin, Haller & McClain

[57] ABSTRACT

Pneumatically operated driving tool for fasteners comprising a working cylinder, a working piston within the working cylinder connected to a driver of the like, a stop in the working cylinder limiting the working stroke of the working piston, a control valve adapted to be actuated by a trigger, a working space above the working piston when the piston is in its upper dead point position, the control valve being adapted to alternatingly connecting the working space with a pressurized air source or with atmosphere, respectively, a piston return chamber surrounding the working cylinder and connected thereto by a first opening adjacent the stop, and a second opening spaced from the stop, the working piston having a smaller diameter than the working cylinder. An annular piston is sealingly displaceably located on the driver and sealingly engages the wall of the working cylinder. The annular piston also sealingly engages the working piston in its upper dead point position, the proportion of the effective areas and the masses of the working piston and the driver blade on one side and of the annular piston on the other side being such that the acceleration of the annular piston during the working stroke is not larger than that of the working piston.

7 Claims, 2 Drawing Sheets

PNEUMATICALLY OPERATED DRIVING TOOL FOR FASTENERS

The invention refers to a pneumatically operated driving tool for fasteners.

A plurality of pneumatically operated driving tools for driving-in nails, staples, pins, bushings or the like having different lengths and different dimensions is generally known. The known driving tools include a driver which is driven by a piston which in turn is sealingly displaceable in an air cylinder. A space above the working piston in its upper dead point position is alternatingly connected to a pressurized air source or to atmosphere, respectively by means of a control valve. The fasteners normally are magazinized in a stripe-like form and are fed toward a driver channel by means of a suitable feeding means, the driver driving the fastener through the driving channel into a workpiece.

It is further known to design a control valve such that a repeated sequence of driving impacts can be initiated as long as the trigger or the like is actuated. By means of such a repetition valve a relatively high striking frequency can be achieved. A repetition valve facilitates the work of an operator since it is not necessary to actuate the trigger for each operation of the driver.

When the working stroke has been finished, the working piston has to be returned to its initial position. It is known to achieve a piston return by spring means. A spring, however, has various disadvantages. The spring may become tired and break off after a respective operation time. Furthermore, a spring requires relatively high additional energy for its deformation along a relatively long spring path. Finally, the deformation of the spring causes friction which leads to loss of energy.

Thus, it is more usual to return the piston by pneumatic operations. To this purpose, the working cylinder is surrounded by a return chamber which is connected to the cylinder through at least two ports. One port is adjacent a stop for the working piston while the other port has a distance from the stop means such that it is above the upper effective area of the working piston when it engages the stop means. By this, the pressurized air enters the return chamber through the upper port and urges the working piston upwardly through the lower port.

Such a pneumatic piston return necessitates that the fastener is nearly or completely driven into the workpiece. In other case, a return effect is in any event achieved by a rebound of the piston. For the subsequent stroke only a small stroke length is available to drive the fastener into the workpiece farther. For this reason, the driving tools are dimensioned such that a single stroke leads to a complete driving-in of the fastener also if the workpiece material is relatively hard. Thus, the sizes and the weight of such tools are considerably determined by the necessary energy for the driving-in of the fastener by one stroke. If relatively thick and long nails are to be operated, the necessary driving tools are reletively heavy and bulky. Further, relatively bulky tools cannot be used under restricted space conditions.

A further disadvantage with known driving tools, particularly for nails in connection with metal sheets to be fastened on beams or the like, consists in the circumstance that the high energy can cause a tear-off of the nail head from the shank, i.e. owing to the extreme deceleration when the nail head impinges on the respective surface of the metal sheet. Despite of trigger safety features, such devices may hurt the operator if upon an unintentional offset of the device the nail impinges on the metal sheet.

Despite of a respective dimensioning of so-called single shot staplers, it cannot be guaranteed to achieve uniform driven-in nails without a manual operation afterwards.

The object of the invention is to provide a pneumatically operated driving tool for fasteners which allows a pneumatic piston return also with partially driven-in fasteners.

In the driving tool according to the invention, an annular piston is located below the working piston. It may consist of a simple disc which sealingly cooperates with the lower surface of the working piston; the annular piston may alternatively include an axial flange which engages the working piston laterally. In the latter case, a sealing can occur also laterally between the working piston and the flange of the annular piston. The annular piston sealingly cooperates with the driver and the working piston. Further, it can be displaced relative to the working piston. It is further significant to the invention that the mass and the effective area of the annular piston in proportion to the mass of the working piston and the driver as well as the effective area of the working piston are such that the annular piston is moved in conjunction with the working piston if a pressure is built up above the working piston through the control valve. Upon its downward movement, the annular piston does not contribute to the driving-in of a fastener by the working piston. If the fastener is partially driven in, the kinetic energy of the driver and the working piston is consumed. The suddenly occurring deceleration of the driver causes a separation of the annular piston from the working piston. Upon a certain relative displacement between working piston and annular piston the originally relatively small effective area of the annular piston is enlarged. Therefore, the annular piston can be moved toward the stop means (stop ring) under acceleration. If engaging the stop means, the piston return can occur according to the above described principle. Since the working piston has a smaller diameter than the inner diameter of the working cylinder, pressurized air may enter the piston return chamber. The return of the annular piston leads also to a return of the working piston towards its upper dead point position as soon as the annular piston engages the working piston from below. The annular piston, thus, is an aid to return the working piston from an arbitrary position between its upper and lower dead point position toward its upper dead point position. The piston return according to the invention enables the design of a usual pneumatically operated single shot driving tool to a multi shot driving tool, the number of shots being depending on the operation time of the trigger and the shot frequency being depending on the respective dimensioning of the control valve.

Therefore, a plurality of driving strokes can occur in an unchanged position of the device on a fastener to be driven in in order to drive-in a fastener completely with an individual stroke having a relatively small energy.

Since with the multi shot driving tool according to the invention the working piston is returned to its upper dead point position after each working stroke, its kinetic driving-in energy increasing with the fastener is driven in more and more per each working stroke. Therefore, the effective driving-in energy increases with increasing driving resistance of the fastener.

The driving tool according to the invention has a plurality of advantages. The operator operates the driving tool as long as he feels or hears that the nail head engages the workpiece. The operator also can proportionate the time for the driving-in process for each nail in accordance with his experience. Therefore, it is also possible to drive-in nails or other fasteners uniformly.

With the driving tool according to the invention, the driving-in energy per shot can be much smaller dimensioned than with single shot devices. The driving-tool according to the invention thus can be dimensioned smaller and with a considerably reduced weight. It is further more simply to be handled and can be also applied under restricted space conditions. It is clear that smaller driving tools require less material and manufacturing costs.

The higher the driving-in energy the more the operator is exposed to a danger if the device is erroneously actuated. The nail may rebound from a metal sheet for instance. With the driving tool according to the invention, the driving energy per shot is considerably smaller so that also a reduced safety risk is existing.

Finally, the fastener is lesser loaded if shot with a driving tool according to the invention. Thus, the danger is eliminated that cracks between the head and the shank of the nail may happen.

The driving tool according to the invention is suited for the driving-in of magazinized or of individual fasteners as well.

Normally, the fasteners are arranged in a stripe to be inserted in a suitable magazine. Staples are arranged to staple rods, nails to nail strips which are held together by plastic bands or the like. In this connection it is also known to provide a suitable feed means in order to feed a fastener into the shot channel after a fastener has been driven out of the channel. In case of U staples a spring-biased feeder is sufficient. In case of nails often a pneumatically feeding means is used. In the device according to the invention, the feed of a nail strip or a nail coil can be controlled such that a nail is feeded into the shot channel only at the beginning of a multiple shot driving-in process. By this, it is prevented that an erroneous triggering occurs or a nail is fed while another is still partially in the shot channel. For the actuation of the feeding means, an additional trigger can be provided. An alternative embodiment provides that the actuation of the feeding means is coupled with the releasing of the trigger level. If after a driving-in process the trigger lever is released, the feeding means is activated and pushes a further fastener in the driving-in channel.

It is also known to associate a mechanical sensor with the mouth of a driving-in channel which sensor is actuated if the driving tool is placed upon the workpiece. The sensor mechanically or pneumatically, respectively, controls the control valve or the trigger valve, respectively, and effects that a shot is only initiated if also the sensor is concurrently actuated. In the driving tool according to the invention, such a sensor can also be used to achieve a nail feed. The feeding means is pneumatically or mechanically activated by the sensor.

If the fasteners are joined to each other, e.g. by an adhesive or by other connection means, such connection is sheared off by the driver. The last fastener, e.g. a nail, thus cannot be retained by the subsequent one. Rather, the danger exists that the nail slides into the driving-in channel.

An embodiment of the invention provides that the area of the driving-in channel where the head of the nail exits the magazine, includes at least one retaining jaw which is radially inwardly biased by at least a spring to retain the nail in the driving-in channel prior to the driving stroke. The retaining jaws originally or alternatively can be magnetic in order to retain the nail in the driving-in channel.

Embodiments of the invention are described herebelow along drawings.

Figure 1:
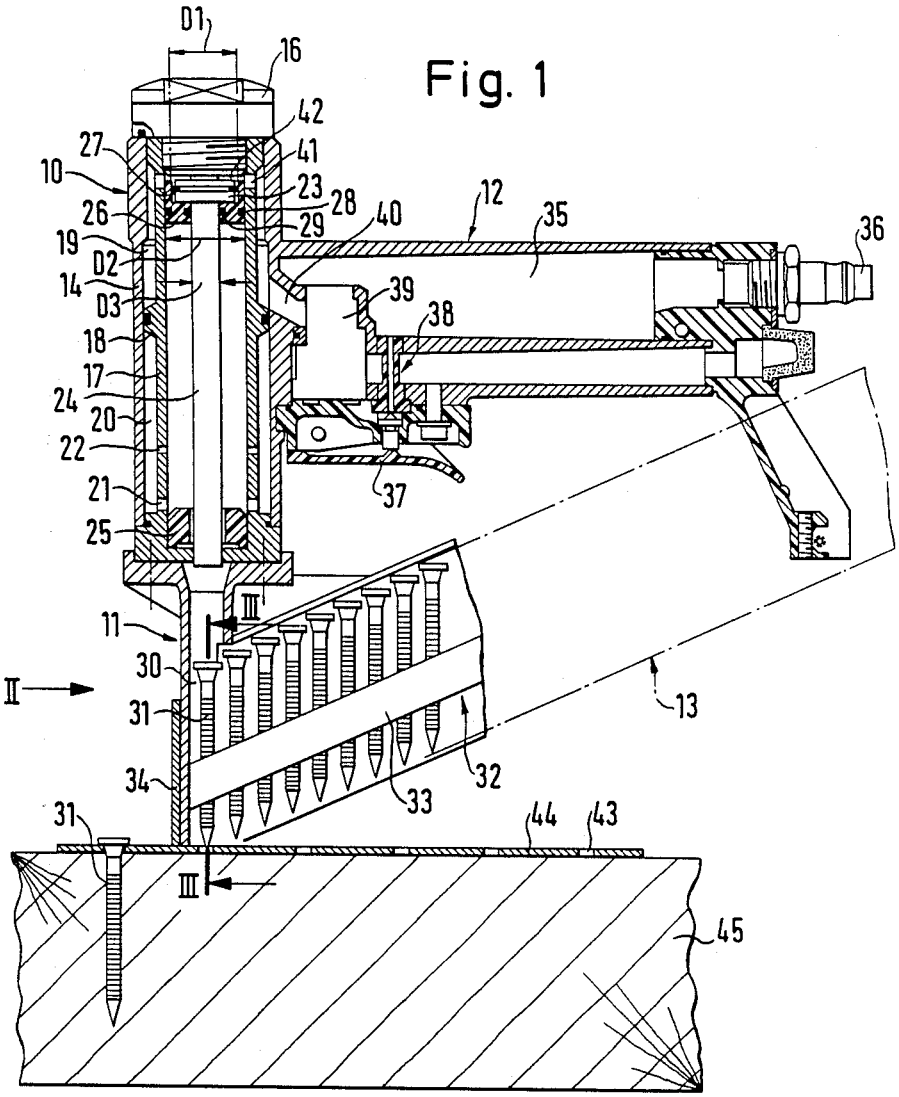
FIG. 1 is a cross-sectional view through a driving tool according to the invention.

Before dealing in more detail with the features shown in the drawings, it is to be noted that each of the described features per se or in connection with features of the claims is significant for the invention.

The driving tool shown in FIG. 1 comprises a cylindrical portion 10, a mouth tool 11 below the cylindrical portion, a gripping portion 12 mounted to the cylindrical portion 10 and a magazine 13 between the mouth tool 11 and an extension of the gripping portion 12.

The cylindrical portion 10 includes a cylindrical housing 14 consisting of two telescopically arranged sleeves, a cap 16 sealingly closing the upper portion of the housing 14 A working cylinder 17 is arranged within the housing 14. It includes an outer radial flange 18 which sealingly cooperates with the inner wall of housing 14. By this, an upper chamber 19 is defined as well as a lower chamber 20. The lower chamber 20 is connected with the interior of the cylinder by lower ports 21 and through upper ports 22. A working piston 23 is located within the cylinder having a diameter smaller than the inner diameter D2 of the working cylinder. A cylindrical driver 24 is attached to the working piston 23, the driver extending through an opening of a stop ring 25 at the lower end of cylinder 17. The working piston 23 is surrounded by a cup-like annular piston 26. A relatively thin-walled cylindrical portion of the annular piston cooperates with a seal 27 of piston 23. A portion of the annular piston 26 having a smaller inner diameter cooperates with the driver 24 through a seal 29. An annular seal 28 on the outer side of annular piston 26 sealingly engages the cylindrical wall. The inner diameter of the effective area of the upper portion of the annular piston 26 is designated with D1 while the diameter of the driver is D3. The mass of piston 23 and of driver 24 on the one side and of the annular piston 26 on the other side as well as the diameter of the effective areas of both pistons are dimensioned such that $$A2 \leqq \frac{A1}{m1 \cdot m2} \qquad 13$$

wherein A1 is the effective area of the working piston 23, A2 the effective area of the upper portion of the annular piston 26, m1 the mass of working piston 23 and driver 24 and m2 the mass of annular piston 26. The functions of the described parts are dealt with below.

In the mouth tool 11 a driving-in channel 30 is provided which receives each a nail of a nail stripe 32 having an annularly corrugated shank the individual nails 31 for example are held together by a plastic strip 33. The nails are guided in the magazine 13 in a manner known per se. A feed means not shown serves for the feeding of the stripe 32 toward the driving-in channel 30. The mouth tool 11 further is associated with a sensor 34, the function thereof will be described later on.

A reservoir 35 is within the gripping portion 12 and connected to an inlet fitting 36 for a connection with a supply conduit in a manner known per se. A trigger lever 37 is pivotally supported at the lower side of the gripping portion. It actuates a trigger valve 38 which in turn cooperates with a repetition control valve 39. The repetition valve is connected to the annular chamber 19 through a bore 40. The annular chamber 19 is connected with a space 42 above the working piston 23 in its upper dead point position or below the plug 16, respectively, through a plurality of bores 41.

The driving tool explained is operated as follows: The not shown preferably pneumatically operating feed means has fed a strip 32 as much as the first nail 31 is located within the driving-in channel 30. This operation occurs after a nail 31 has been driven through a hole 43 in the sheet 44 on beam 45 into beam 45. If the trigger lever 37 is actuated, the control valve 39 effects that the space 42 is connected to the air reservoir 35. Subsequently, the working piston 23 is moved downwardly. The already mentioned proportion of the effective areas and of the masses is such that the annular piston 26 by no means is no more accelerated as the working piston 23. Therefore, the annular piston 26 is pushed by the working piston 23. The driving energy, however, is dimensioned such that normally the nail 31 is not driven into the workpiece 45 by one stroke.

By this, there is no danger that the operator may be hurt if the nail impinges on the metal sheet.

Rather, the nail 31 is driven in only about a certain amount while the driver 24 and in conjunction therewith the working piston 23 is relatively strongly decelerated and finally stopped. The inertial energy of the annular piston 26 effects that the annular piston 26 continues its travel downwardly. By this, the upper portion of the annular piston disengages seal 29 of piston 23 and the effective area exposed to the working pressure is enlarged so that annular piston 26 is moving downwardly with a larger acceleration. At that moment, when the upper surface of the annular piston has passed the ports 22, pressurized air may enter the return chamber through ports 22, the pressurized air then may be supplied to the annular piston 26 through ports 21. Thus, the annular piston 26 is pneumatically returned (in the known manner corresponding to the pneumatic piston return with known driving tools). The return stroke of the annular piston 26 takes with it the working piston 23 and moves it to its upper dead point position.

The control valve 39 is a repetition valve, i.e. a relief or a venting of the pressure space 42 is followed by a pressurizing step. The control valve 39 can exert an arbitrary number of pressure strokes onto the working piston 23, the number of the strokes depending on the time how long the trigger lever 37 is actuated. If the working piston 23 has reached its upper dead point position, the control valve 29 effects a further driving-in stroke. The shown driving tool thus is a multi-shot-driving tool. Therefore, the operator will actuate the trigger lever 37 as long as he observes or feels that the nail is completely driven in. It has to be mentioned that the control valve is of known design. It is, thus, not necessary to describe its function in more detail.

Figure 4:
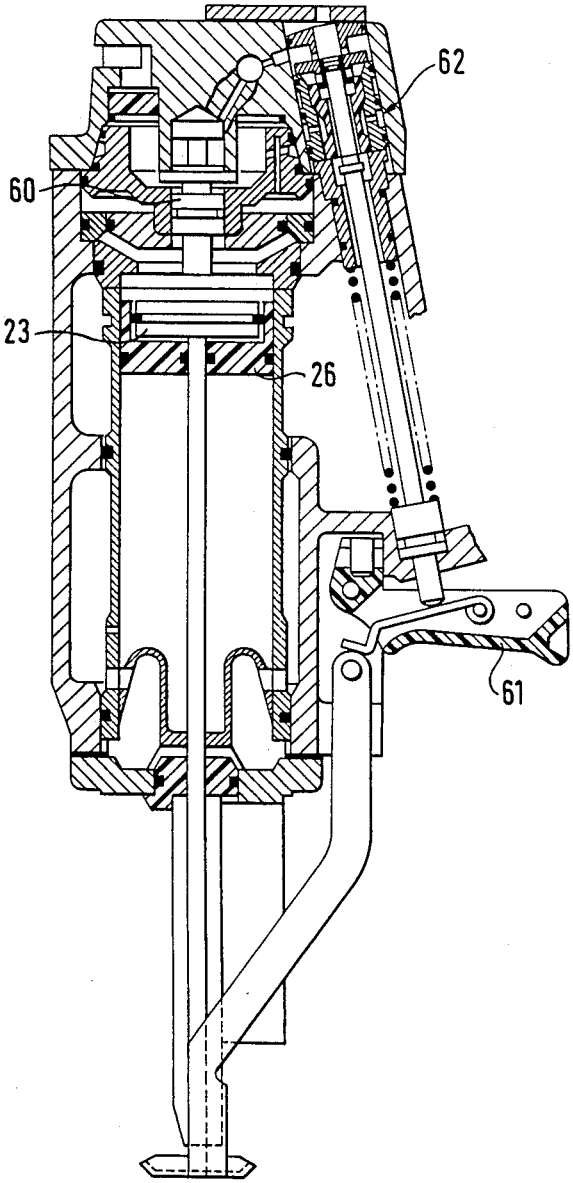
FIG. 4 shows a cross section of a driving tool according to the invention having a different control valve.

FIG. 4 shows a further usual design of a repetition valve which is structured as so-called head valve system 60. It can serve also for a pneumatic control of the pressure supply to the pistons 23, 26. Also, this repetition valve is indirectly operated by a trigger lever 61 through a known trigger valve 62. Upon actuation, this repetition valve leads to an alternative pressure supply and pressure relief of the pressure space above the piston arrangement 23, 26 as already explained.

Figure 2:
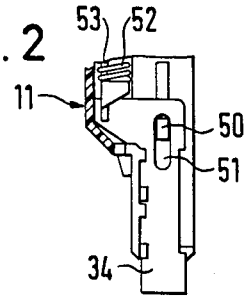
FIG. 2 shows a view of the driving tool according to FIG. 1 in the direction of arrow 2 while only a small portion is shown.

In FIG. 2 it can be seen that at the outer portion of the mouth tool 11 a L-like sensor plate 34 is axially displaceably supported, the limitation is achieved by a tab 50 which engages an elongated hole 51 in plate 34. The transverse leg of plate 34 cooperates with a spring 52 and an actuation rod 53. The actuation rod serves for either the mechanical engagement of the trigger valve 38 or the control valve 39 or the indirect cooperation with the not shown pneumatic feed of the nail strip 37. The control by means of the sensor 34 can be such that the feed means feeds the nail strip 32 about a distance between two nail axes and to feed a nail into the driving-in channel 30 when the sensor 34 is displaced upwardly upon a placement on a workpiece. By this, it is achieved that an erroneous triggering of the working piston 23 does not lead to a shot of a nail by which the operator or other persons could be exposed to danger. The sensor 34 can effect an additional security function in that a triggering by means of the trigger lever 37 is locked. It is understood that the feed means can be controlled by other means, e.g. through the trigger lever 37. For example, the feed of a nail can be carried out at that moment, when the operator releases the trigger lever 37 after a multi stroke actuation.

Figure 3:
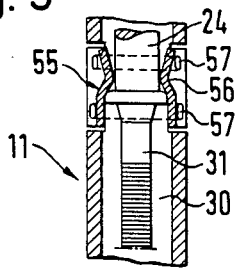
FIG. 3 is a cross-sectional view along line 3—3 of FIG. 1.

As can be clearly seen in FIG. 1, the nail fed into the driving-in channel is held by the connection band 33. Thus, the nail cannot slide out of the driving-in channel. However, the last nail of a strip cannot be retained in this manner. It can be seen in FIG. 3 that an axial portion of the upper portion of the driving-in channel 30 is confined by a plurality of jaws 55.

The jaws diverge upwardly so that upon an unintended initiation driver 24 does not strike against the jaws 55 in case no nail is in the driving-in channel 30, the jaws 55 in a released position have a minimum distance from each other. If a nail 31 is fed into the driving-in channel 30, its head is engaged by the jaws 55. Upon a stroke, the driver 24 engages the nail head and urges it out of the range of the jaws. The narrowest cross section between the jaws 55 is preferably dimensioned such that the driver 24 may freely pass. The jaws 55 may be magnetic in order to increase the retaining effect for a nail 31.

I claim:

1. A pneumatically operated driving tool for fasteners comprising a working cylinder, a working piston assembly within said working cylinder, stop means in said working cylinder limiting the working stroke of said working piston assembly, a control valve adapted to be actuated by a trigger, a working space above said working piston assembly when said piston is in its upper dead point position, said control valve being adapted to alternatingly connect said working space with a pressurized air source or with atmosphere, respectively, piston return means connected to said working cylinder through an opening adjacent said stop means in order to return said piston assembly from a lower deadpoint position at said stop means to an upper deadpoint position said working piston assembly having a first piston with a smaller diameter than said working cylinder a driver connected to said first piston, an annular piston being sealingly displaceable on said driver and sealingly engaging the wall of said working cylinder, said annular piston also sealingly engaging said first piston, said annular piston being adapted to freely slide on said driver, the proportion of the effective areas and the masses of said first piston and said driver blade on one side and of said annular piston on the other side being such that the acceleration of said annular piston during the working stroke is not larger than that of the first piston, and the upon sudden deceleration of said driver with said first piston being between said upper and said lower deadpoint position, said annular piston disengages said first piston and continues its travel towards said stop means and is returned form said lower deadpoint position into engagement with said first piston by said piston return means.

2. The driving tool according to claim 1, wherein the cross section of the driver is circular.

3. The driving tool according to claim 1, wherein the upper effective areas of both pistons are approximately aligned if the annular piston engages said first piston.

4. The driving tool according t claim 1, wherein feed means are provided feeding a strip of fasteners toward a driving-in channel and wherein a fastener is fed into the driving-in channel just before an initiation of a driving-in stroke.

5. The driving tool according to claim 4, wherein the mouth tool is associated with a sensor (34) which is actuated upon placing the driving tool on a workpiece and wherein the feed means are controlled by said sensor.

6. The driving tool according to claim 1, wherein the driving-in channel in the area where the fasteners exit the magazine includes at least one retaining jaw which is radially inwardly biased by at least one spring to retain a fastener in the driving-in channel for the driving-in operation.

7. The driving tool according to claim 6, wherein the retaining jaw is magnetic.

* * * * *